US006787058B2

(12) United States Patent
Foister et al.

(10) Patent No.: US 6,787,058 B2
(45) Date of Patent: Sep. 7, 2004

(54) LOW-COST MR FLUIDS WITH POWDERED IRON

(75) Inventors: Robert T. Foister, Rochester Hills, MI (US); Vardarajan R. Iyengar, Macomb, MI (US); Sally M. Yurgelevic, Eastpointe, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/292,075

(22) Filed: Nov. 12, 2002

(65) Prior Publication Data

US 2003/0102455 A1 Jun. 5, 2003

Related U.S. Application Data

(60) Provisional application No. 60/337,947, filed on Nov. 13, 2001.

(51) Int. Cl.[7] ..... H01F 1/44

(52) U.S. Cl. ..... 252/62.52; 252/62.55; 252/62.56

(58) Field of Search ..... 252/62.52, 62.56, 252/62.55

(56) References Cited

U.S. PATENT DOCUMENTS

| | | | | |
|---|---|---|---|---|
| 4,957,644 | A | 9/1990 | Price et al. | 252/62.52 |
| 4,992,190 | A | 2/1991 | Shtarkman | 252/62.52 |
| 5,354,488 | A | 10/1994 | Shtarkman et al. | 252/62.56 |
| 5,382,373 | A | 1/1995 | Carlson et al. | 252/62.55 |
| 5,578,238 | A | 11/1996 | Weiss et al. | 252/62.52 |
| 5,599,474 | A | 2/1997 | Weiss et al. | 252/62.52 |
| 5,645,752 | A | 7/1997 | Weiss et al. | 252/62.54 |
| 5,667,715 | A | 9/1997 | Foister | 252/62.52 |
| 5,670,077 | A | 9/1997 | Carlson et al. | 252/62.52 |
| 5,842,547 | A | 12/1998 | Carlson et al. | 188/267 |
| 5,906,767 | A | 5/1999 | Karol et al. | 252/62.52 |
| 5,985,168 | A | 11/1999 | Phule | 252/62.52 |
| 5,989,447 | A | 11/1999 | Podszun et al. | 252/62.52 |
| 6,027,664 | A | 2/2000 | Weiss et al. | 252/62.52 |
| 6,132,633 | A | 10/2000 | Carlson | 252/62.52 |
| 6,186,290 | B1 | 2/2001 | Carlson | 188/164 |
| 6,203,717 | B1 | 3/2001 | Munoz et al. | 252/62.52 |
| 6,395,193 | B1 | 5/2002 | Kintz et al. | 252/62.52 |
| 6,592,772 | B2 * | 7/2003 | Foister et al. | 252/62.52 |

OTHER PUBLICATIONS

Hamill et al., *Fine Particle Atomization Technology*, Eurotech Conference Proceedings, Munich, Oct. 1999.

Hamill et al., *Water Atomized Fine Powder Technology*, http://www.hoeganaes.com/home.htm, 4 pp, date unknown.

* cited by examiner

*Primary Examiner*—C. Melissa Koslow
(74) *Attorney, Agent, or Firm*—Michael D. Smith

(57) ABSTRACT

An MR fluid formulation comprising water-atomized iron powder dispersed in a liquid vehicle, wherein the atomized iron powder contributes to a higher magnetic effect, a lower viscosity and suitability for high temperature applications. The magnetizable particles are prepared by controlled water atomization and comprise iron having a passivating oxide surface layer. The passivating oxide surface layer advantageously comprises iron oxide and at least one alloying metal oxide, such as manganese oxide. Advantageously, the particles have a grain size of at least 4 $\mu$m and a mean diameter in the range of about 8–25 $\mu$m. The liquid vehicle advantageously comprises a mixture of at least two liquid components of different surface functionality and an organoclay stabilization mixture in which at least one organoclay is selected for each liquid vehicle component. Exemplary MR fluid formulations of the present invention utilize a high-viscosity, low volatility base fluid, water-atomized iron powder, multi-component organoclays and multi-component additives to achieve the desired viscosity and durability of a fully formulated MR fluid which will satisfy the requirements of second and third generation MR fluids.

52 Claims, 3 Drawing Sheets

LOW-COST MR FLUIDS WITH POWDERED IRON

Pursuant to 37 C.F.R. §1.78(a)(4), this application claims the benefit of and priority to prior filed Provisional Application Serial No. 60/337,947, filed Nov. 13, 2001, which is expressly incorporated herein by reference.

TECHNICAL FIELD

This invention relates to the use of water-atomized powdered iron in a magnetorheological (MR) fluid.

BACKGROUND OF THE INVENTION

Magnetorheological (MR) fluids are substances that exhibit an ability to change their flow characteristics by several orders of magnitude and in times on the order of milliseconds under the influence of an applied magnetic field. These induced rheological changes are completely reversible. The utility of these materials is that suitably configured electromechanical actuators that use magnetorheological fluids can act as a rapidly responding active interface between computer-based sensing or controls and a desired mechanical output. With respect to automotive applications, such materials are seen as a useful working media in shock absorbers, brakes for controllable suspension systems, vibration dampers in controllable power train and engine mounts and in numerous electronically controlled force/torque transfer (clutch) devices.

MR fluids are non-colloidal suspensions of finely divided (typically one to 100 micron diameter) low coercivity, magnetizable solids such as iron, nickel, cobalt, and their magnetic alloys dispersed in a base carrier liquid such as a mineral oil, synthetic hydrocarbon, water, silicone oil, esterified fatty acid or other suitable organic liquid. MR fluids have an acceptably low viscosity in the absence of a magnetic field but display large increases in their dynamic yield stress when they are subjected to a magnetic field of, e.g., about one Tesla. The iron particles are kept suspended in the liquid by the action of a thixotrope or anti-settling agent. Special additives are also used to reduce oxidation of the base fluid and iron particles, reduce friction, reduce wear, and improve durability.

In the context of automotive applications, MR fluids have been developed to pass shock absorber durability testing, while minimizing settling and in-use thickening. This has largely been accomplished by careful specification of components of the formulation. For example, prior art fluids have used soft carbonyl iron to provide low-coercivity, high yield strength, and consistent properties over life for MR fluids, together with a single-component organoclay thixotrope to minimize settling of the MR fluid. By way of example, U.S. Pat. No. 6,203,717 describes the use of single-component organoclays to achieve stable MR fluids. In addition, typical prior art MR fluids contain additives, such as organomolybdenums, ZDDP, thiocarbamates, and phosphorous-containing compounds in low concentration (about 1–2%) to minimize in-use thickening and reduce wear of mechanical components.

First generation MR fluids generally have an operating temperature range of −40–70° C., with excursions up to 105° C. These fluids pass the 1 Million cycle side-loaded durability tests with no in-use thickening, and exhibit acceptable settling properties. Although prior art first generation MR fluids do have the desirable properties listed above, it has been found that compositions formulated in accordance with the prior art still tend to have the following disadvantages, which are serious impediments to their utilization in future applications, including second generation and third generation automotive applications: high cost, due to expensive soft carbonyl iron powder ($6.15–$18 per pound); high volatility, particularly when the base fluids are chosen to provide acceptable low-temperature viscosity, or alternatively, unacceptably high viscosity when the base fluids are chosen to provide high volatility at high temperature; and noticeable loss of performance over time due to oxidation of the soft carbonyl iron particles. The second and third generation MR fluids require a wider operating temperature range, specifically −40° C.–130° C. continuous exposure, with up to 150° C. excursions. The second generation MR fluids will require 25% higher on-state forces, and third generation MR fluids will require 100% higher on-state forces. Both second and third generation MR fluids will require a 25% decrease in off-state forces and 50% decrease in cost, as well as lower friction. These requirements must be met without any compromise in durability and settling performance.

The problems of prior art MR fluids can be traced to specific material components and combinations, rather than inherent shortcomings of the technology itself. For example, viscosity and volatility in prior art fluids can be attributed to the combinations of base fluid, single-component organoclay thickener, and additives that are taught in the prior art. The combination of the single-component clay thickener with the additives generally results in fluids that have high viscosity, when the fluid is formulated for optimum stability to settling. Additionally, the use of soft or reduced carbonyl iron as taught in the prior art is the most significant factor in the cost of the raw materials that make up the MR fluid. In a 20 vol. % iron MR fluid, for example, the majority (>90%) of the raw material cost comes from the carbonyl iron powder. Also, carbonyl iron powder is >99% pure iron, and is therefore highly susceptible to oxidation. It is likely that oxidation of the iron powder is the cause for observed loss in magnetic performance in MR dampers over time.

The carbonyl process involves the thermal decomposition of iron pentacarbonyl that yields high purity iron. The particles are smooth and generally spherical, with diameters typically in the range of 1–10 $\mu$m. However, carbonyl iron is liable to oxidize in use, in part due to its high level of purity. Oxidation of the carbonyl iron has been observed in MR fluids used in fan clutch and shock absorber applications, for example. Oxidation can occur as a result of exposure to high temperatures and/or moisture. Carbonyl iron powders typically begin to oxidize in air at temperatures well below 200° C. In a clutch application, for example, the MR fluid often reaches over 200° C. Oxidation of the iron particles can reduce the magnetorheological effect of the fluid by as much as 20% or more. Iron oxide exhibits poorer magnetic properties than pure carbonyl iron. Moreover, the yield stress for the MR fluid decreases over time, and this is believed to be a result of one or both of the oxidation of the carbonyl iron particles or a change in the shape and size distribution of the particles. This reduction in effectiveness can severely affect device performance.

There is thus a need for an MR fluid formulation that maintains the durability, anti-settling and thickening properties of prior MR fluids while improving oxidation resistance and magnetic performance and reducing cost.

SUMMARY OF THE INVENTION

The present invention provides an MR fluid formulation comprising water-atomized iron powder dispersed in a liquid vehicle, wherein the atomized iron powder contributes to a higher magnetic effect, a lower viscosity and suitability for high temperature applications due to a low oxidation rate, these benefits particularly noticeable in comparison to similar fluids using carbonyl iron particles. In an exemplary embodiment of the present invention, the magnetizable particles are prepared by controlled water atomization and comprise iron having a passivating oxide surface layer, and a mean diameter in the range of about 8–25 $\mu$m. In a further exemplary embodiment, the passivating oxide layer is an alloy of iron and at least one other metal and their oxides. In another exemplary embodiment of the present invention, the liquid vehicle is a mixture comprising at least two liquid components of different surface functionality. In this embodiment, an organoclay stabilization mixture is added in which at least one organoclay is selected for each liquid vehicle component with each organoclay having a surface chemistry that renders it preferentially compatible with the surface functionality of one of the liquid components relative to its compatibility to the remaining liquid components whereby it is effective to stabilize, or gel, that component. The use of the dual-clay mixture in combination with standard additives provides stable, durable MR fluids that have low viscosity. Exemplary MR fluid formulations of the present invention utilize a high-viscosity, low volatility base fluid, water-atomized iron powder, multi-component organoclays and multi-component additives to achieve the desired viscosity and durability of a fully formulated MR fluid which will satisfy the requirements of second and third generation MR fluids.

The present invention further provides a method of making an MR fluid. The method includes blending a liquid vehicle mixture of at least two liquid components, each having a different surface functionality and adding at least one surface-treated organoclay for each liquid component to the liquid vehicle mixture. The surface treatment of each organoclay renders that organoclay preferentially compatible with the surface functionality of its respective liquid component relative to the compatibility of the organoclay to the remaining liquid components. The method further includes dispersing magnetizable particles in the liquid vehicle mixture, which particles have been prepared by controlled water atomization and comprise iron having a passivating oxide surface layer and a mean diameter in the range of about 8–25 $\mu$m. The method may further include adding one or more additives to the liquid vehicle mixture, such as an organomolybdenum complex, an organomolybdenum thiocarbamate, a zinc dithiophosphate, and an organothiocarbamate.

BRIEF DESCRIPTION OF THE DRAWINGS

The present invention will now be described, by way of example, with reference to the accompanying drawings, in which.

DETAILED DESCRIPTION

The present invention is directed to an MR fluid formulation in which water-atomized iron powder having a passivating oxide layer thereon is dispersed in a liquid vehicle. The iron powder is produced by a controlled, water atomization process. By "controlled" it is meant that the atomization parameters are selected so as to produce smooth, generally spherical particles of small diameter and narrow size distribution. One skilled in the art may appreciate that there are a number of key variables that influence the size and shape of the atomized particles. These variables include water or gas pressure, melt stream velocity and temperature, nozzle design, jet size, apex angle and water/metal ratios. By control of the various parameters, smooth, generally spherical iron particles may be obtained with a narrow size distribution and a mean diameter in the range of about 8–25 $\mu$m. Advantageously, the particle distribution range is between about 1 $\mu$m and about 50 $\mu$m. The particles are generally spherical, though not necessarily uniformly spherical. Exemplary high-pressure, water-atomized iron powders may be obtained from Hoeganaes Corp. (N.J.) and Hoganas AB (Sweden). Inert gas-atomized iron powders of the desired morphology and size are not generally available commercially due to the considerable expense of such powders compared to similar water-atomized particles, but would be suitable with respect to their properties if made available.

The atomized iron particles are used in place of or in combination with carbonyl iron particles used in prior MR fluid formulations. The atomized iron powder may also be used with atomized magnetic stainless steel particles as disclosed in co-pending application Ser. No. 09/805,084 entitled MR FLUIDS CONTAINING MAGNETIC STAINLESS STEELS, commonly owned, and incorporated by reference herein in its entirety. Thus, the MR fluid of the present invention may comprise magnetizable particles dispersed in a liquid vehicle, wherein the magnetizable particles comprise atomized powdered iron alone or in combination with one or both of atomized stainless steel powder and carbonyl iron powder.

Figure 1:
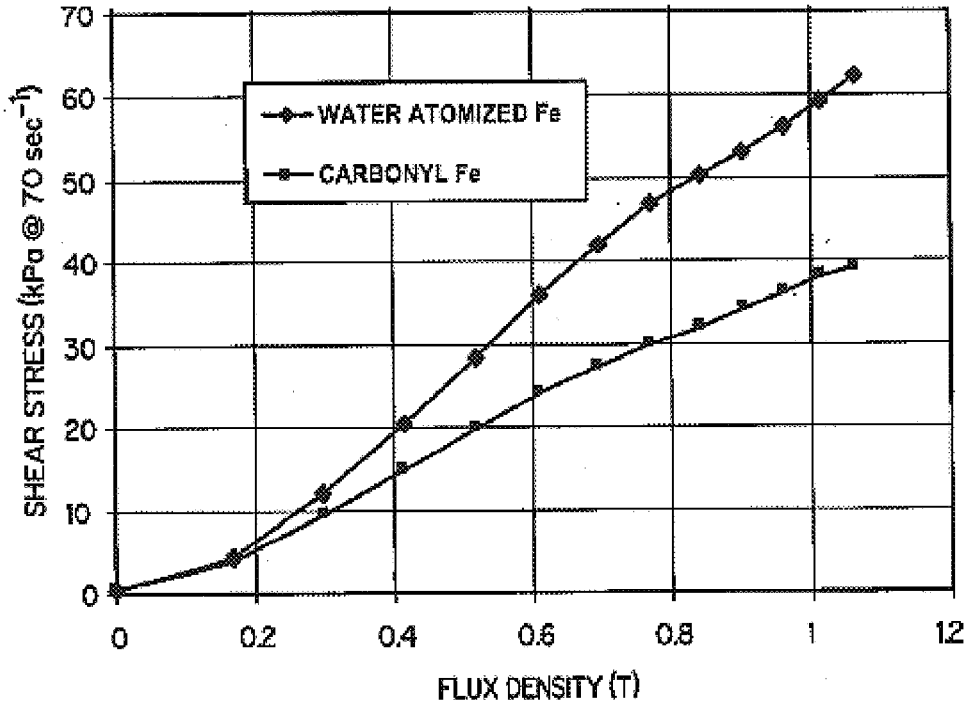
FIG. 1 is a comparison of the MR effect for an MR fluid containing water-atomized powdered iron versus the MR effect for an MR fluid containing carbonyl iron.

Many unexpected benefits are realized by using the atomized powdered iron, particularly in combination with a dual organoclay thickener and anti-wear and anti-friction additives, as will be discussed below. One unexpected benefit is that the atomized powdered iron has better magnetic properties than carbonyl iron. FIG. 1 is a graph of flux density, in Teslas, as a function of shear stress for an MR fluid containing a water-atomized iron powder in accordance with the present invention compared to an MR fluid containing a carbonyl iron in accordance with prior art MR fluid formulations. The grain size characteristic of the microstructure of the atomized powdered iron is significantly larger than that of both reduced and unreduced carbonyl iron. Carbonyl irons typically comprise particles with grains on the order of 0.2–2 $\mu$m, and even as small as 0.01–2 $\mu$m for some grades. The water-atomized iron powder, on the other hand, comprises particles with grain sizes of about 4 $\mu$m or larger, for example, about 4–10 $\mu$m. Grain size influences the strength and efficiency of the magnetic field induced in the particles in the presence of an external magnetic field, with larger grain size leading to higher permeability, more efficient magnetization and higher inherent MR effect.

Figure 2:
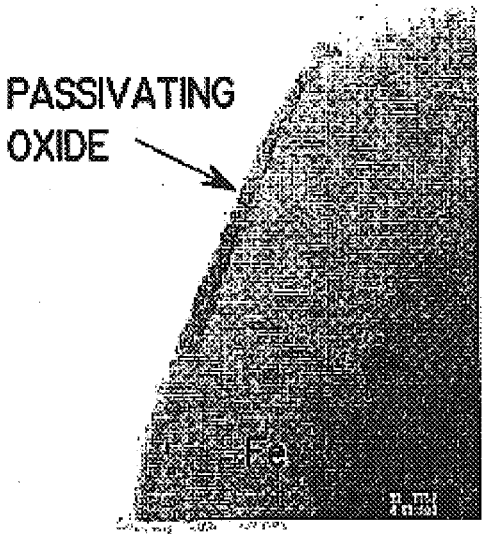
FIG. 2 is a Transmission Electron Micrograph (TEM) of a water-atomized powdered iron particle showing an iron core and a passivating oxide surface layer.

Another unexpected benefit of the powdered iron produced by controlled atomization is that the particles have a passivating oxide layer on the surface of the iron particle, as depicted in the transmission electron microscopy micrograph of FIG. 2. This oxide layer, which is engineered during the controlled atomization process, renders the powdered iron more resistant to oxidation than the carbonyl iron particles. Advantageously, the passivating oxide layer includes iron alloyed with at least one other metal, for example, aluminium, manganese and/or silicon. For example, the passivating oxide may include $Fe_3O_4$, $Al_2O_3$, $Mn_xO_y$ (where x=1, 2 or 3 and y=1, 2, 3, 4 or 7) and/or $SiO_2$. This is expected to have a beneficial effect on the consistency of magnetic performance of MR shock absorbers over time, minimizing the reduction of MR effect due to oxidation observed with carbonyl iron-based systems. The type of oxide formed on the iron particle surfaces can be manipulated by controlling the atmosphere in the atomizing chamber and/or by specific additions of alloying elements to the iron melt. In an exemplary embodiment, the surface layer is a mixed oxide of iron, manganese and/or aluminium, and silicon.

Figure 3:
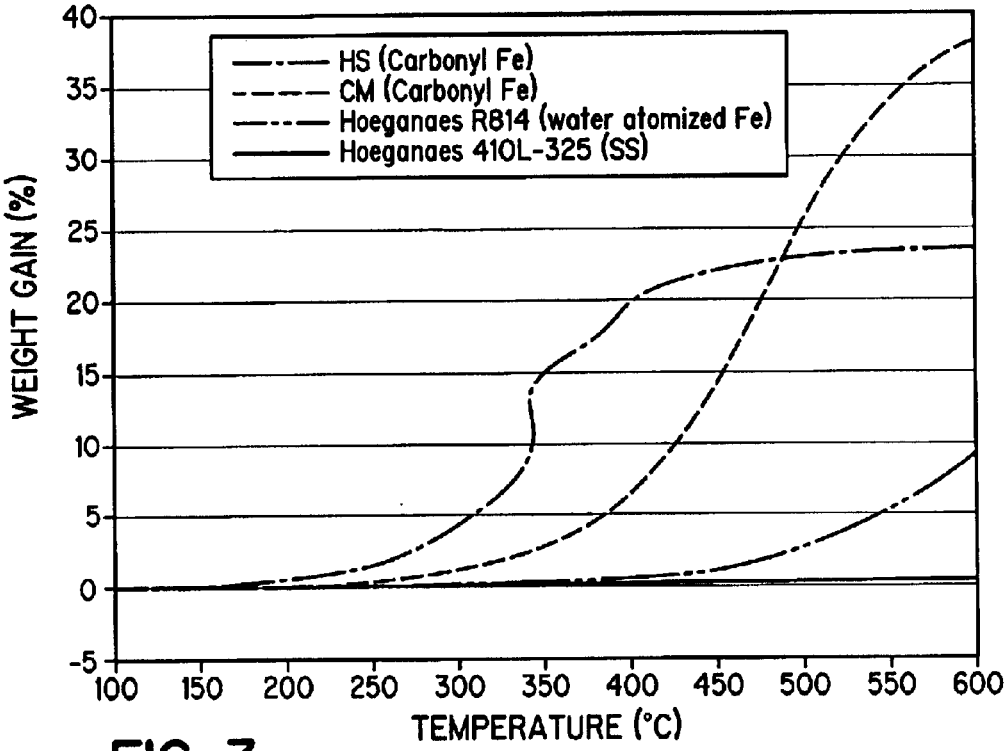
FIG. 3 is a graphical depiction of the variation in weight gain due to oxidation with increase in temperature for various iron powders and stainless steel powder.

FIG. 3 graphically depicts the weight gain due to oxidation of two typical carbonyl iron powders (Grades HS and CM from BASF Corp., N.J.) produced by the thermal decomposition process, an iron powder processed by controlled water atomization (Grade R814 from Hoeganaes Corp., N.J.), and a martensitic stainless steel powder produced by controlled water atomization (Grade 410L-325 from Hoeganaes Corp., N.J.), each heated in air and weighed throughout heating. The HS carbonyl iron powder began to gain weight at temperatures below 200° C., and the CM carbonyl iron powder began to gain weight below 250° C. The water-atomized iron began to slowly gain weight at temperatures above 400° C., and the type 410 stainless steel had no appreciable weight gain. This evidences the tendency of carbonyl iron to oxidize, particularly at temperatures at which the MR fluid is likely to be exposed, since iron oxide has a higher molecular weight than iron, thus accounting for the weight gain at increasing temperatures. Both the iron and the stainless steel produced by controlled water atomization had little to no appreciable weight gain, thereby evidencing little to no oxidation of the particles with increasing temperature up to about 400–450° C. Thus, the atomized magnetic particles exhibit little to no oxidation at temperatures at which the MR fluid is likely to be exposed.

Figure 4:
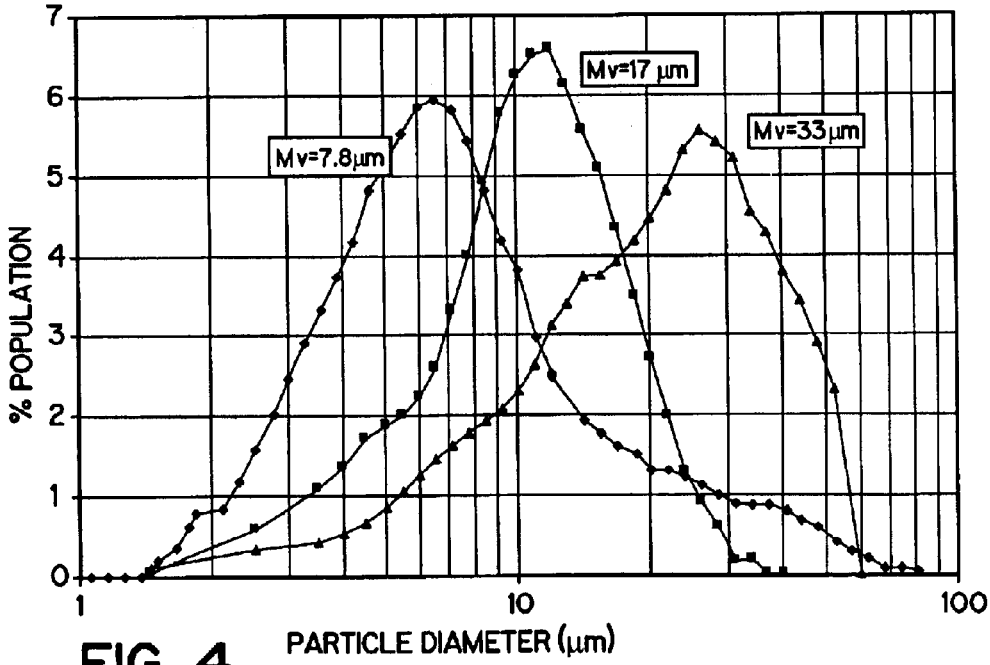
FIG. 4 is a graphical depiction of the particle size distributions for various iron powders.
Figure 5A:
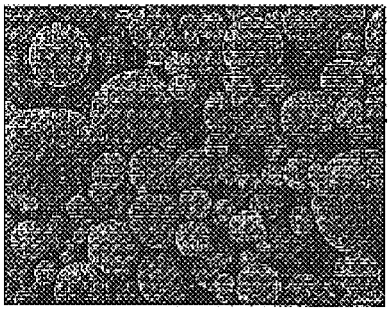
FIG. 5A PRIOR ART
FIGS. 5A–5C are Scanning Electron Micrographs (SEMs) of a carbonyl powder, a water atomized iron powder and a standard powdered iron, respectively.
Figure 5B:
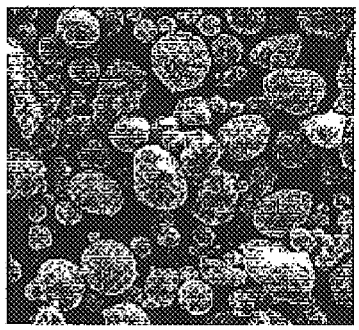
Figure 5C:
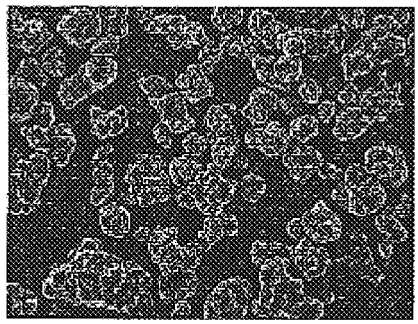
FIG. 5C PRIOR ART

Another unexpected benefit of the atomized powdered iron is that an MR fluid made with the atomized powdered iron has lower viscosity compared to identical MR fluids made with carbonyl iron. Without being bound by theory, the reason for this unexpected benefit may pertain to differences in the particle size distribution between the powdered and the carbonyl iron materials and/or differences in the interactions between the surface chemistries of the iron particles with the thixotropes and additives. FIG. 4 graphically depicts the particle size distribution of an iron powder prepared by controlled water atomization (Grade R842 from Hoeganaes Corp.) compared to the size distributions of the Grade CM carbonyl iron powder (from BASF Corp.) and a standard powdered iron prepared by means other than controlled water atomization. The atomized iron powder exhibits the highest concentration of particles at and near the mean particle size, which is 17 $\mu$m for this grade, and exhibits a narrow, fine particle distribution, which is 1.5–40 $\mu$m for this grade, making it ideal for use in MR fluids. FIGS. 5A–5C are micrographs of the carbonyl iron, water-atomized iron, and standard powdered iron, respectively, shown in graphical format in FIG. 4. As can be seen in FIG. 5B, the water-atomized iron particles have a smooth surface morphology, and are generally but not uniformly spherical. In comparison, the carbonyl iron is smooth and uniformly spherical with a broad, fine particle size distribution, and the standard powdered iron has rough, irregularly shaped particles with a broad, large particle size distribution.

Due to the unexpectedly low viscosity obtained by substituting atomized powdered iron for the standard carbonyl iron, it is possible to use low-volatility base fluids to produce MR fluids that are capable of high-temperature operation without significantly increasing the viscosity of the MR fluid compared to that of prior art high-volatility fluids. An exemplary liquid vehicle and organoclay package is described in co-pending application Ser. No. 10/015,981 entitled STABILIZATION OF MAGNETORHEOLOGICAL FLUID SUSPENSION USING A MIXTURE OF ORGANOCLAYS, commonly owned, and incorporated by reference herein in its entirety, now U.S. Pat. No. 6,572,772.

In an exemplary embodiment of the present invention, the liquid vehicle or liquid carrier phase is a miscible blend of at least two liquid components having different surface chemistries wherein the liquid components are used to suspend the magnetizable particles but do not otherwise react with the particles. Advantageously, the liquid vehicle is a combination of a synthetic hydrocarbon and a synthetic diester. Hydrocarbon liquids, which by virtue of their chemical make-up are essentially non-polar, include but are not limited to mineral oils, vegetable oils, and synthetic hydrocarbons. Polyalphaolefin (PAO) is a suitable base hydrocarbon liquid for shock absorbers as well as many other MR fluid applications in accordance with this invention. However, the polyalphaolefin does not have suitable lubricant properties for some applications including shock absorbers. Therefore, PAO is used in mixture with known lubricant liquids such as liquid synthetic diesters. Examples of diester liquids include dioctyl sebacate (DOS) and alkyl esters of tall oil type fatty acids. Methyl esters and 2-ethyl hexyl esters have also been used. By virtue of their chemical make-up, the diester liquids are essentially polar.

In an exemplary embodiment of the present invention for use in the shock absorber application, the MR fluid formulation comprises about 50–90% by volume PAO, which is the synthetic hydrocarbon of non-polar chemistry, and about 10–50% by volume DOS, which is the synthetic diester of polar chemistry used for lubrication and to optimize seal swell. In a further exemplary embodiment of the present invention, the MR fluid formulation contains PAO and DOS in a ratio of about 80:20 by weight, though this ratio may be adjusted to optimize seal swell, volatility, pour point, viscosity and the like. By way of further example, a 2.5 cst PAO, which consists primarily of dimers of 1-dodecene, has adequate stability in shock absorbers where maximum temperatures do not exceed 100–105° C. However, for other shock absorber devices with continuous use temperatures of 80–100° C. and excursions that can exceed 130–140° C., the 2.5 cst PAO may be too volatile for the higher temperatures. Thus, a higher molecular weight, lower volatility PAO, such as one based primarily on trimers of 1-decene (SHF 41, available commercially from Exxon-Mobil Corp.) or 1-dodecene (ORONITE® 5, available commercially from Chevron-Phillips Corp.) can be substituted for the 2.5 cst PAO in a base fluid formulation comprising the PAO blended with DOS. Although the higher molecular weight PAO typically results in higher base fluid viscosity, the fundamental chemistry of the fluid mixture is virtually identical regardless of whether high or low weight PAO is used, as long as the PAO:DOS ratio remains constant. Of particular advantage in the present invention is that PAO and DOS have distinctly different chemistries. One qualitative measure of this difference is that PAO is essentially non-polar, while DOS is relatively polar in nature.

Because PAO and DOS are chemically different, a combination of the two, although miscible, will have a chemistry that reflects the relative composition of the two components. Therefore, an organoclay that stabilizes, or gels, a PAO liquid vehicle would not necessarily do the same, at least not to the same extent, for a blend of PAO and DOS. The concentration of the PAO relative to DOS might have to be substantially increased to achieve gelatin in the PAO/DOS mixture, but this would likely result in an unacceptable increase in viscosity of the MR fluid. Likewise, an organoclay that stabilizes, or gels, a DOS liquid vehicle would not necessarily do the same for a mixture of PAO and DOS. Thus, in accordance with an exemplary embodiment of the present invention, a combination of organoclays is incorporated in the MR fluid, with one organoclay having a surface chemistry that is preferentially compatible with the surface chemistry of the PAO, and another organoclay with a surface chemistry preferentially compatible with the surface chemistry of the DOS. In other words, one organoclay stabilizes or gels the PAO and one organoclay stabilizes or gels the DOS, resulting in a stabilized mixture. By way of example, an organoclay with a non-polar surface chemistry will readily disperse in the PAO but not in the DOS, while an organoclay with a more polar character will not disperse readily in PAO, but will in the DOS. Thus, a mixture of a non-polar surface treated organoclay and a polar surface treated organoclay may be employed in an MR fluid comprising a non-polar PAO and a polar DOS.

Advantageously, the organoclays are provided in a relative concentration chosen to optimize key suspension properties, such as settling, viscosity, and MR effect. Generally, the organoclay mixture may comprise about 0.25–10% by weight of the liquid vehicle, and each organoclay may comprise about 0.5–15% by weight of its compatible liquid vehicle component. For example, for the 80:20 PAO/DOS mixture, the formulation may comprise about 4 wt. % organoclay mixture, of which about 3.5 wt. % is the PAO-compatible organoclay, and about 0.5 wt. % is the DOS-compatible organoclay. By way of example and not limitation, CLAYTONE® EM, commercially available from Southern Clay Products, Gonzales, Tex., is a hydrocarbon-compatible non-polar organoclay and thus is preferentially compatible to PAO. CLAYTONE® LS, also commercially available from Southern Clay Products, is an ester-compatible polar organoclay, and thus is preferentially compatible to DOS. In other words, the surface chemistry of the CLAYTONE® EM is such that it exhibits an affinity for the surface functional groups of the PAO. Likewise, the surface chemistry of the CLAYTONE® LS is such that it exhibits an affinity for the surface functional groups of the DOS.

Various additives may also be included in the MR fluid formulations. For example, in the exemplary shock absorber application, the formulation may include anti-wear and anti-friction additives in the amount of about 0.5 to 3% by volume. Examples of such additives include an organomolybdenum complex, such as MOLYVAN® 855, an organomolybdenum thiocarbamate, such as MOLYVAN® 822, and an organothiocarbamate, such as VANLUBE® 7723, each of which is available commercially from R. T. Vanderbilt Co., Inc., Norwalk, Conn., and a zinc dithiophosphate, such as LUBRIZOL® 677A, available from Lubrizol Corporation, Wickliffe, Ohio.

In accordance with the present invention, MR fluids are made with high-pressure water-atomized iron powder in combination with optimized dual-clay mixtures in low-volatility base fluids (low-volatility PAOs and low-volatility diesters, and any combination of these fluids) together with various combinations of anti-wear and anti-oxidant additives. Such fluids have performed well in shock absorber durability tests. A particular embodiment of an MR fluid formulation in accordance with the present invention includes the following components listed in TABLE 1:

TABLE 1

| | |
|---|---|
| Hoeganaes Water-atomized Iron Powder R842 | 2041.1 g |
| Exxon-Mobil PAO SHF 41 (low-volatility PAO) | 591.8 g |
| Union Camp UNIFLEX ® DOS (low-volatility diester) | 166.0 g |
| Organoclay compatible with PAO | 26.52 g |
| Organoclay compatible with diester | 3.8 g |
| R. T. Vanderbilt MOLYVAN ® 822 | 11.4 g |
| R. T. Vanderbilt VANLUBE ® 7723 | 11.4 g |

Figure 6:
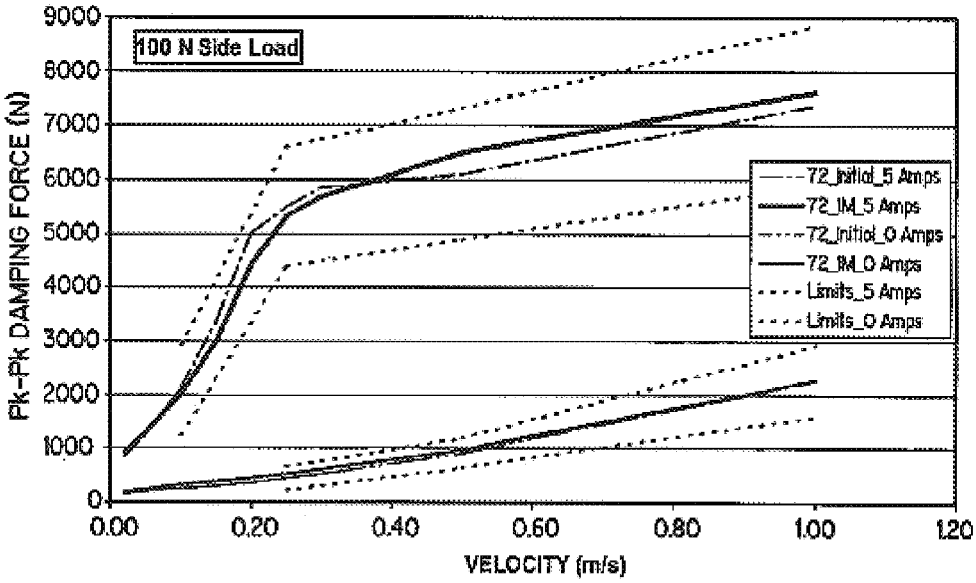
FIG. 6 is a graphical depiction of the variation in peak—peak damping force with increasing velocity for an MR fluid of the present invention.

The R842 powder includes a passivating oxide surface layer comprising each of iron oxide, manganese oxide and silicon oxide. The formulation provided above has successfully passed a 1 Million cycle (100,000 mi) durability test under 100N side load at both 0 Amps and 5 Amps, as provided in FIG. 6. In addition to low volatility, which is achieved by the choice of base fluid composition, this particular embodiment of the invention, which uses a combination of organoclays and anti-wear/anti-oxidant additives, also has a viscosity lower than that of current first generation formulations. TABLE 2 provides various MR fluid properties of first generation and second generation MR fluids, as well as the third generation MR fluid of the present invention.

TABLE 2

| MR FLUID FORMULATION (22%/vol solids) | GEN I FLUID VERSION 1 | GEN I FLUID VERSION 2 | GEN II FLUID VERSION 1 | GEN II FLUID VERSION 2 | GEN III HIGH TEMP FLUID |
|---|---|---|---|---|---|
| Viscosity[1] (cP, 40° C.) | 65 | 30–40[6] | 53 | 17–30[6] | 45–85[6] |
| Fluid Phase Volatility[2] (% Wt. loss, 130° C., 22 h) | 0.65 | 0.65 | 1.7 | 1.7 | 0.26 |
| Fluid Phase Volatility[2] (% Wt. loss, 150° C., 22 h) | 2.3 | 2.3 | 4.4 | 4.4 | 0.81 |
| Short Term Settling[3] (%) | 0.8 | — | 0.8 | — | 0.8 |
| Long Term Settling[4] (%) | 17 | — | 12 | — | 5 |

TABLE 2-continued

| MR FLUID FORMULATION (22%/vol solids) | GEN I FLUID VERSION 1 | GEN I FLUID VERSION 2 | GEN II FLUID VERSION 1 | GEN II FLUID VERSION 2 | GEN III HIGH TEMP FLUID |
|---|---|---|---|---|---|
| Sediment Hardness[5] (N) | 3.4 | — | 2.4 | — | 1.3 |

[1]Measured using a cup-and-bob geometry at 40° C.

[2]Measured by heating the base fluid in an oven to a specified temperature and holding at that temperature for 22 hours. The weight loss from the uncovered container is measured and expressed as a percentage of the original weight of the fluid.

[3]For short term settling, the MR fluid is placed in a transparent container overnight (12 hrs. minimum) and the height of the clear layer that forms is measured and divided by the total height of the MR fluid. The ratio is expressed as a percentage.

[4]For long term settling, the MR fluid is subjected to thermal cycling in an oven: −30° C. to +100° C., with the temperature cycling about twice each day between the two extremes. The fluid containers are tapped on a flat surface once a day during testing to increase the settling tendency. After 12 days of settling, the containers are removed from the thermal chamber. Some iron settles to the bottom and a clear layer of base fluid is present at the top. The height of the clear layer is measured and divided by the total MR fluid height. The ratio is expressed as a percentage.

[5]Measured by driving a penetrometer (0.25 in. diameter cylinder) into the settled iron. A load cell measures the force required to drive the penetrometer into the sediment at a constant speed of 1 cm per second. The maximum force measured by the load cell is reported as the sediment hardness in Newtons.

[6]Dependent on type of solid, type and amount of dual organoclay, and additive package.

The first generation fluid, version 1, uses a base fluid comprising a mixture of 2.5 cst PAO, SHF 41 PAO and DOS in a ratio of 50:30:20. The magnetizable particles are carbonyl iron, and the thickener is a single organoclay. The fluid formulation further contains anti-wear and anti-oxidant additives. The version 2 first generation fluid of the present invention substitutes atomized powdered iron for the carbonyl iron and a dual organoclay mixture, as described above, wherein one organoclay is compatible with PAO and one organoclay is compatible with DOS. The version 2 first generation fluid further includes anti-wear and anti-oxidant additives that are different than that used in version 1. Specifically, version 2 includes MOLYVAN® 822 and VANLUBE® 7723. The version 2 first generation fluid achieves a lower viscosity than version 1, while maintaining the same low volatility of 0.65% after 22 hours at 130° C., and 2.3% after 22 hours at 150° C. Version 1 of the second generation fluid is similar to version 1 of the first generation fluid, but uses 2.5 cst PAO and DOS in a ratio of 80:20, and thus eliminates the low volatility SHF 41 PAO. Version 2 of the second generation fluid is similar to version 2 of the first generation fluid, but again, changing the base fluid to the 80:20 mixture of 2.5 cst PAO:DOS. Again, lower viscosity is achieved for the powdered iron and dual organoclay version compared to the carbonyl iron and single organoclay version 1, while maintaining the same volatility between the two versions. In comparing the second generation fluids to the first generation fluids, the second generation fluids achieve relatively lower viscosity at the expense of higher volatility. The second generation fluids also achieve an improvement in long term settling and sediment hardness. The third generation fluid, which is particularly suitable for high temperature applications, is similar to the version 2 second generation fluid, but substitutes the lower volatility SHF 41 PAO for the 2.5 cst PAO, still maintaining the 80:20 ratio of PAO:DOS. By carefully selecting the clay mixture and the additive package, in combination with water-atomized iron and a low volatility base fluid, viscosities comparable to that of the version 1 first generation fluid may be obtained while achieving low volatility. Further, a decrease in long term settling and sediment hardness are observed compared to both the first generation and second generation version 1 fluids.

For dampers operating at high temperatures, low volatility is essential to prevent fluid from escaping the damper due to evaporation. While the volatility requirements vary depending on particular applications, it is generally the case that a lower volatility is better. Lower volatility typically means high viscosity, but the third generation high temperature fluid of the present invention achieves low volatility without unacceptably high viscosity. Depending on the particular type and level of organoclay mixture and additive package, the viscosity ranges from about 45–85 cP, which is comparable to the 65 cP obtained in the first generation fluids. In addition, settling affects the performance of the MR fluid device. Generally, long term settling of greater than 10% is undesirable, and settling greater than 20% is unacceptable. While the first and second generation fluids do not exceed 20% settling, they do not meet the 10% requirement of many applications. Only the third generation high temperature fluid of the present invention exhibits less than 10% long term settling. If the fluid has settled, then the action of the device, e.g., a damper, can redisperse the iron particles. The hardness of the sediment determines the ease of redispersion of the MR fluid after it has settled. Thus, a lower sediment hardness is desirable. Generally, penetrometer force of less than 2 Newtons is very desirable, and force greater than 5 Newtons are unacceptable. While both the first and second generation fluids achieve less than 5 Newtons sediment hardness, only the third generation high temperature fluid of the present invention achieves less than 2 Newtons.

In addition to the performance benefits that can be obtained by the MR fluids of the present invention, by using water-atomized iron powder instead of carbonyl iron powder as the magnetically susceptible solid phase, a potential raw material cost savings of approximately 40% can be obtained.

A further comparison was made between carbonyl iron and atomized powdered iron, and between different clay and additive packages. Four MR fluids were made according to the formulations provided in TABLE 3, all using the same low-volatility/high-viscosity base oil mixture, as used in the third generation fluid in TABLE 2.

TABLE 3

| | FLUID 1 | FLUID 2 | FLUID 3 | FLUID 4 |
|---|---|---|---|---|
| PAO SHF 41:Uniflex DOS | 80:20 | 80:20 | 80:20 | 80:20 |
| Carbonyl Iron Powder CM (Wt. % of liquid) | 22 | — | 22 | — |
| Water-atomized Iron Powder R842 (Wt. % of liquid) | — | 22 | — | 22 |
| CLAYTONE ® EM (Wt. % of liquid) | 3.5 | 3.5 | 6.0 | 6.0 |
| GARAMITE ® LS (Wt. % of liquid) | 0.5 | 0.5 | 1.0 | 1.0 |
| MOLYVAN ® 822 (Wt. % of liquid) | 1.5 | 1.5 | — | — |
| MOLYVAN ® 855 (Wt. % of liquid) | — | — | 1.5 | 1.5 |
| VANLUBE ® 7723 (Wt. % of liquid) | 1.5 | 1.5 | 1.5 | 1.5 |

Fluids 1 and 2 had lower viscosity compared to Fluids 3 and 4, which is evidence that the type and/or amount of organoclay and antiwear/antifriction additives affect the viscosity of the MR fluid for any given type of magnetic particles. Fluid 2 and Fluid 4 had lower viscosity than Fluid 1 and Fluid 3, respectively, which is evidence of the unexpected effect of the atomized iron powder on viscosity. Fluid 2 had the lowest viscosity due to the water-atomized iron powder in combination with the dual clay thickener in optimized amounts and typical antiwear and antifriction additives. Each of Fluids 1–4 passed the 1 Million cycle side-loaded damper durability test, and all four fluids perform better than prior-art fluids (carbonyl iron and single clay) in settling tests.

Standard grades of powdered iron tend to promote paste-formation, or "in use thickening" according to durability testing. While controlled, water-atomized iron particles are, in general, an improvement over carbonyl iron, particularly with respect to raw material cost, a further improvement in durability is achieved where the passivating oxide layer includes at least one metal in addition to iron. The additional metal may be manganese, silicon, aluminum or the like, and the form of the alloying element is understood to include the element alone or its oxide. The alloyed oxide layer provides a stronger and more stable oxide layer than an iron oxide layer absent metal alloying elements. The examples below in TABLE 4 provide a comparison for MR fluids comprising 22 vol. % iron powder having an alloyed oxide layer versus an unalloyed oxide layer, both types of powder prepared by water atomization, and both having a mean particle diameter of about 17 $\mu$m.

TABLE 4

| | FLUID 5 | FLUID 6 | FLUID 7 |
|---|---|---|---|
| Bulk Composition of Iron Particles (Wt. %) | 98.91% Fe<br>0.54% O<br>0.04% C<br>0.012% S<br>0.46% Mn<br>0.034% Si | 98.91% Fe<br>0.54% O<br>0.04% C<br>0.012% S<br>0.46% Mn<br>0.034% Si | 98.7% Fe<br>1.26% O<br>0.017% C<br>0.008% S |
| Fluid Phase (wt. %) | 80% 4 cst PAO;<br>20% DOS | 80% 4 cst PAO;<br>20% DOS | 80% 4 cst PAO;<br>20% DOS |
| Organoclay (wt. %) | 3.5% Claytone ® EM;<br>0.5% Claytone ® LS | 6.0% Claytone ® EM;<br>0.5% Claytone ® LS | 3.5% Claytone ® EM;<br>0.5% Claytone ® LS |
| Additives (wt. %) | 1.5% Molyvan ® 822;<br>1.5% Vanlube ® 7723 | 1.5% Molyvan ® 855;<br>1.5% Vanlube ® 7723 | 1.5% Molyvan ® 822;<br>1.5% Vanlube ® 7723 |

The iron powder used in Fluids 5 and 6 was the R842 product obtained from Hoeganaes Corp, referred to above. The manganese, silicon and oxygen were mainly concentrated in the surface oxide layer. Thus, the oxide layer was an alloy surface layer comprising iron oxide, manganese oxide and silicon oxide. The iron powder used in Fluid 7 was the R814 product obtained from Hoeganaes Corp, referred to above. The surface layer consists entirely of various oxides and/or hydroxides of iron. Each of fluids 5–7 completed a 1 M cycle accelerated durability test at 70° C. However, Fluid 7 exhibited paste formation, whereas Fluids 5 and 6 exhibited no paste formation and essentially no reduction of on-state forces. Thus, the MR fluids that include at least one alloying metal in the iron oxide passivating layer are capable of achieving all requirements for second and third generation fluids, including high on-state forces and acceptable durability and settling properties while reducing raw material costs in comparison with carbonyl iron-based fluids.

As stated above, particular mention has been made of shock absorbers for land-based vehicles. Other devices include, but are not limited to: brakes, pistons, clutches, dampers, exercise equipment, controllable composite structures and structural elements. Particular mention has also been made of PAO and DOS, and of CLAYTONE® EM and CLAYTONE® LS as exemplary organoclays having preferential compatibility with PAO and DOS, respectively. It should be understood, however, that there are numerous other liquid vehicle components and organoclays that may be used in accordance with the present invention. It should be further understood that the present invention is not limited to a two-component system. The base liquid vehicle may contain a mixture of two or more liquid components, and two or more organoclays are selected, in accordance with the present invention, for preferential compatibility with each liquid component.

What is claimed is:

1. A magnetorheological fluid formulation comprising magnetizable particles dispersed in a liquid vehicle mixture, the magnetizable particles prepared by controlled water atomization and comprising iron having a passivating oxide surface layer, and a mean diameter in the range of about 8–25 $\mu$m.

2. The fluid formulation of claim 1 wherein the particles have a grain size in the range of about 4–10 $\mu$m.

3. The fluid formulation of claim 1 wherein the magnetizable particles have a size distribution ranging from about 1–50 $\mu$m.

4. The fluid formulation of claim 1 wherein the passivating oxide surface layer comprises iron and at least one alloying metal.

5. The fluid formulation of claim 1 wherein the passivating oxide surface layer comprises at least one of iron oxide, aluminium oxide, manganese oxide and silicon oxide.

6. The fluid formulation of claim 5 wherein the passivating oxide surface layer comprises each of iron oxide, manganese oxide and silicon oxide.

7. The fluid formulation of claim 1 wherein the liquid vehicle mixture comprises a non-polar hydrocarbon liquid component and a polar diester liquid component, and the formulation further comprises a non-polar hydrocarbon-compatible organoclay and a polar ester-compatible organoclay.

8. The fluid formulation of claim 7 wherein the non-polar hydrocarbon liquid component is a polyalphaolefin consisting primarily of dimers of 1-dodecene.

9. A magnetorheological fluid formulation comprising magnetizable particles dispersed in a liquid vehicle mixture, the magnetizable particles prepared by controlled water atomization and comprising iron and a passivating oxide surface layer of iron oxide and at least one alloying metal oxide.

10. The fluid formulation of claim 9 wherein the magnetizable particles have a grain size in the range of about 4–10 $\mu$m and a mean diameter in the range of about 8–25 $\mu$m.

11. The fluid formulation of claim 9 wherein the at least one alloying metal oxide includes manganese oxide.

12. The fluid formulation of claim 9 wherein the liquid vehicle mixture comprises a non-polar hydrocarbon liquid component and a polar diester liquid component, and the formulation further comprises a non-polar hydrocarbon-compatible organoclay and a polar ester-compatible organoclay.

13. The fluid formulation of claim 12 wherein the non-polar hydrocarbon liquid component is a polyalphaolefin consisting primarily of dimers of 1-dodecene.

14. A magnetorheological fluid formulation comprising:

a liquid vehicle mixture comprising at least two liquid components, each liquid component having a different surface functionality;

magnetizable particles dispersed in the liquid vehicle mixture and comprising iron having a passivating oxide surface layer;

at least one different organoclay for each liquid vehicle component, each organoclay having a surface chemistry which is preferentially compatible with the surface functionality of one of the liquid components relative to its compatibility to the remaining liquid components; and at least one additive selected from the group consisting of: an organomolybdenum complex, an organomolybdenum thiocarbamate, a zinc dithiophosphate, and an organothiocarbamate.

15. The fluid formulation of claim 14 wherein the magnetizable particles have a mean diameter the range of about 8–25 $\mu$m.

16. The fluid formulation of claim 14 wherein the magnetizable particles have a grain size of at least 4 $\mu$m.

17. The fluid formulation of claim 16 wherein the grain size is in the range of about 4–10 $\mu$m.

18. The fluid formulation of claim 14, wherein the magnetizable particles are prepared by controlled water atomization and have a generally smooth morphology.

19. The fluid formulation of claim 14 wherein the magnetizable particles have a size distribution ranging from about 1–50 $\mu$m.

20. The fluid formulation of claim 14 wherein the passivating oxide surface layer comprises iron and at least one alloying metal.

21. The fluid formulation of claim 14 wherein the passivating oxide surface layer comprises iron oxide, aluminium oxide, manganese oxide and silicon oxide.

22. The fluid formulation of claim 14 wherein the passivating oxide surface layer comprises each of iron oxide, manganese oxide and silicon oxide.

23. The fluid formulation of claim 14 wherein the liquid vehicle mixture comprises a non-polar hydrocarbon liquid component and a polar diester liquid component, and the at least one different organoclay includes a non-polar hydrocarbon-compatible organoclay and a polar ester-compatible organoclay.

24. The fluid formulation of claim 14 wherein the liquid vehicle mixture includes a hydrocarbon liquid.

25. The fluid formulation of claim 14 wherein the liquid vehicle mixture includes a polyalphaolefin.

26. The fluid formulation of claim 25 wherein the polyalphaolefin consists primarily of dimers of 1 dodecene.

27. The fluid formulation of claim 14 wherein the liquid vehicle mixture includes a diester.

28. The fluid formulation of claim 14 wherein the liquid vehicle mixture includes dioctyl sebacate.

29. The fluid formulation of claim 14 wherein the liquid vehicle mixture includes about 50–90% by volume polyalphaolefin and about 10–50% by volume dioctyl sebacate.

30. The fluid formulation of claim 29 wherein the different organoclay for the polyalphaolefin is present in an amount of about 0.5–15% by weight of the polyalphaolefin and the different organoclay for the dioctyl sebacate is present in an amount of about 0.5–15% by weight of the dioctyl sebacate.

31. The fluid formulation of claim 14 wherein each different organoclay is present in an amount of about 0.5–15% by weight of the liquid component to which it is preferentially compatible.

32. The fluid formulation of claim 14 wherein the organoclays are present in a total amount of about 0.25–10% by weight of the liquid vehicle mixture.

33. A magnetorheological fluid formulation comprising:

a liquid vehicle mixture comprising a non-polar hydrocarbon liquid component and a polar diester liquid component;

magnetizable particles dispersed in the liquid vehicle mixture, the magnetizable particles prepared by controlled water atomization and comprising iron having a passivating oxide surface layer of iron oxide and at least one alloying metal oxide, and having a mean particle diameter in the range of about 8–25 $\mu$m;

a non-polar hydrocarbon-compatible organoclay and a polar ester-compatible organoclay; and at least one additive selected from the group consisting of: an organomolybdenum complex, an organomolybdenum thiocarbamate, a zinc dithiophosphate, and an organothiocarbamate.

34. The fluid formulation of claim 33 wherein the liquid vehicle mixture includes about 50–90% by volume polyalphaolefin and about 10–50% by volume dioctyl sebacate.

35. The fluid formulation of claim 33 wherein the magnetizable particles have a grain size of at least 4 $\mu$m.

36. The fluid formulation of claim 35 wherein the grain size is in the range of about 4–10 $\mu$m.

37. The fluid formulation of claim 33 wherein the magnetizable particles have a size distribution ranging from about 1–50 $\mu$m.

38. The fluid formulation of claim 33 wherein the alloying metal oxide is at least one of manganese oxide, aluminium oxide or silicon oxide.

39. The fluid formulation of claim 33 wherein the organoclays are present in a total amount of about 0.25–10% by weight of the liquid vehicle mixture.

40. A method of making an MR fluid comprising:

blending a liquid vehicle mixture including at least two liquid components, each liquid component having a different surface functionality;

adding at least one surface-treated organoclay for each liquid component in the liquid vehicle mixture, wherein the surface treatment of each added organoclay renders the organoclay preferentially compatible with the surface functionality of one of the liquid components relative to the compatibility of the organoclay to the remaining liquid components; and dispersing magnetizable particles in the liquid vehicle mixture, wherein the magnetizable particles are prepared by controlled water atomization and comprise iron having a passivating oxide surface layer, and a mean diameter in the range of about 8–25 $\mu$m.

41. The method of claim 40 wherein blending the liquid vehicle mixture comprises blending a non-polar hydrocarbon liquid component and a polar diester liquid component, and wherein adding the organoclay includes adding a non-polar hydrocarbon-compatible organoclay and a polar ester-compatible organoclay.

42. The method of claim 40 wherein a hydrocarbon liquid is blended in the liquid vehicle mixture.

43. The method of claim 40 wherein a polyalphaolefin is blended in the liquid vehicle mixture.

44. The method of claim 40 wherein a diester is blended in the liquid vehicle mixture.

45. The method of claim 40 wherein dioctyl sebacate is blended in the liquid vehicle mixture.

46. The method of claim 40 wherein blending the liquid vehicle mixture includes blending about 50–90% by volume polyalphaolefin with about 10–50% by volume dioctyl sebacate.

47. The method of claim 46 wherein the organoclay for the polyalphaolefin is added in an amount of about 0.5–15% by weight of the polyalphaolefin and the organoclay for the dioctyl sebacate is added in an amount of about 0.5–15% by weight of the dioctyl sebacate.

48. The method of claim 40 wherein adding the organoclay includes adding each organoclay in an amount of about 0.5–15% by weight of the liquid component to which it is preferentially compatible.

49. The method of claim 40 wherein adding the organoclay includes adding a total organoclay content of about 0.25–10% by weight of the liquid vehicle mixture.

50. The method of claim 40 further comprising adding at least one additive selected from the group consisting of an organomolybdenum complex, an organomolybdenum thiocarbamate, a zinc dithiophosphate, and an organothiocarbamate.

51. The method of claim 40 wherein the passivating oxide surface layer of the magnetizable particles prepared by controlled water atomization comprises iron oxide and at least one alloying metal oxide.

52. The method of claim 51 wherein the alloying metal oxide is at least one of manganese oxide, silicon oxide and aluminum oxide.

* * * * *